US005722814A

United States Patent [19]

Yu

[11] Patent Number: 5,722,814

[45] Date of Patent: Mar. 3, 1998

[54] FAN BLADE MOUNTING DEVICE HAVING A DECORATIVE MEMBER PROVIDED THEREON

[76] Inventor: Chai-Chi Yu, No. 24, Lane 1, Ta-Chih St., Tan-Yang Tsun, Tan-Tzu Hsiang, Taichung Hsien, Taiwan

[21] Appl. No.: 832,457

[22] Filed: Apr. 3, 1997

[51] Int. Cl.[6] ..... F04D 29/00

[52] U.S. Cl. ..... 416/204 R; 416/5

[58] Field of Search ..... 416/204 R, 210 R, 416/5

[56] References Cited

U.S. PATENT DOCUMENTS 5,304,037 4/1994 Scofield ..... 416/500
5,458,463 10/1995 Chiang ..... 416/5
5,458,464 10/1995 Lee ..... 416/5
5,669,760 9/1997 Chen ..... 416/210

*Primary Examiner*—John T. Kwon
*Attorney, Agent, or Firm*—Ladas & Parry

[57] ABSTRACT

A mounting device is to be secured to a bottom side of a connecting end portion of a fan blade of a ceiling fan. The mounting device includes a decorative member and a mounting arm having a plate-like blade mounting end portion which is to be disposed horizontally beneath the connecting end portion of the fan blade and which is formed with an insert hole that complements the decorative member for retaining the decorative member thereon, and a plurality of screw sockets that are disposed around the insert hole. Screw fasteners extend through the connecting end portion of the fan blade to engage the screw sockets and retain the mounting arm on the fan blade.

12 Claims, 3 Drawing Sheets

FAN BLADE MOUNTING DEVICE HAVING A DECORATIVE MEMBER PROVIDED THEREON

BACKGROUND OF THE INVENTION

1. Field of the Invention

The invention relates to a mounting device for mounting a fan blade on a rotor of a ceiling fan, more particularly to a fan blade mounting device which has a decorative member provided thereon.

2. Description of the Related Art

Conventional ceiling fans are provided with mounting devices for mounting fan blades on a rotor thereof. A known mounting device includes a mounting am having a plate-like blade mounting end portion which is secured to a top side of a connecting end portion of a fan blade by means of screws. In order to enhance the aesthetic appeal of the ceiling fan, decorative members are provided on bottom sides of the fan blades and are secured to the latter by means of the same screws used in securing the mounting arms on the fan blades.

It is noted that the conventional mounting device and decorative member are relatively inconvenient to install in view of the need to align screw holes in the blade mounting end portion of the mounting arm with through holes in the connecting end portion of the fan blade and with screw sockets on the decorative member. In addition, the assembly of the conventional mounting device and decorative member is relatively heavy and has a more expensive raw material requirement, thereby resulting in increased costs.

SUMMARY OF THE INVENTION

Therefore, the main object of the present invention is to provide a fan blade mounting device which has a decorative member and which can be conveniently installed on a connecting end portion of a fan blade of a ceiling fan.

Another object of the present invention is to provide a fan blade mounting device with a decorative member, the fan blade mounting device being relatively lightweight and having a less expensive material requirement, thereby resulting in reduced costs.

According to the present invention, a mounting device is adapted to be secured to a bottom side of a connecting end portion of a fan blade of a ceiling fan, and comprises: a decorative member; a mounting arm having a plate-like blade mounting end portion which is to be disposed horizontally beneath the connecting end portion of the fan blade and which is formed with an insert hole that complements the decorative member for retaining the decorative member thereon, and a plurality of screw sockets that are disposed around the insert hole; and a plurality of screw fasteners adapted to extend through the connecting end portion of the fan blade to engage the screw sockets and retain the mounting arm on the fan blade.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
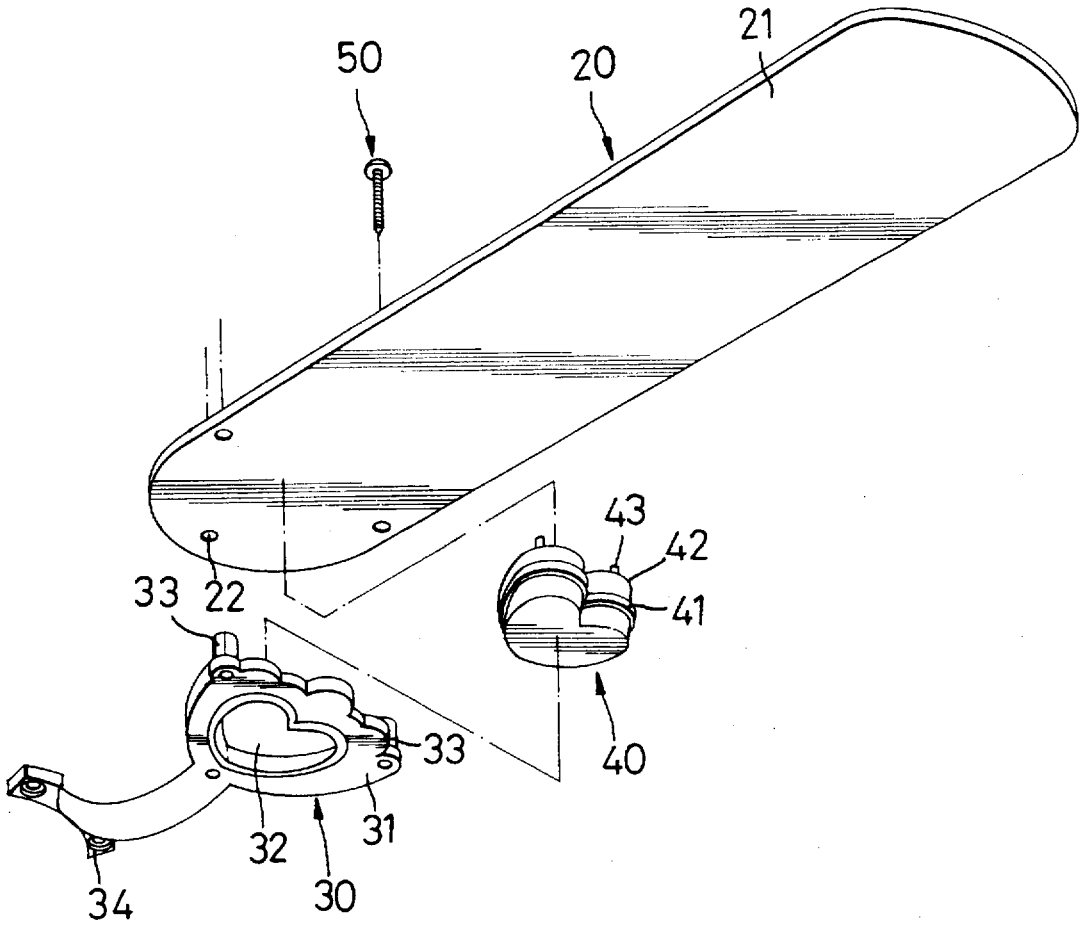
FIG. 1 is an exploded view of the preferred embodiment of a fan blade mounting device according to the present invention.

Referring to FIG. 1, the preferred embodiment of a fan blade mounting device according to the present invention is shown to comprise a mounting arm 30, a decorative member 40 and a plurality of screw fasteners 50 (only one is shown) for securing the mounting arm 30 on a connecting end portion 21 of a fan blade 20 of a ceiling fan.

The fan blade 20 is conventional in construction and is formed as an elongated plate with fastener holes 22 provided in the connecting end portion 21 thereof. In this embodiment, there are three fastener holes 22.

Figure 3:
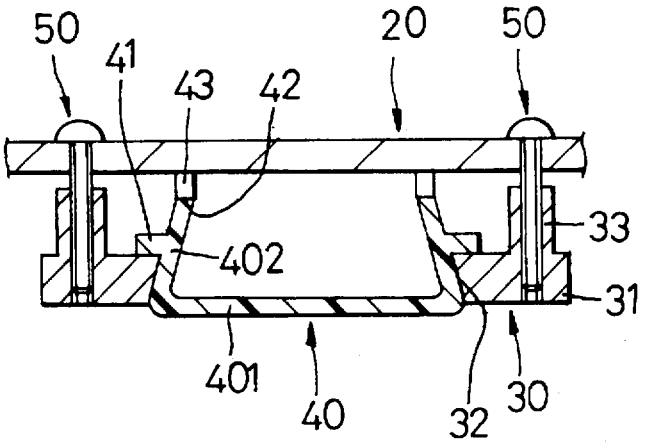
FIG. 3 is a sectional view of the preferred embodiment, taken along line III—III in FIG. 2.

The mounting arm 30 is made of cast metal and has a plate-like blade mounting end portion 31 formed with an insert hole 32 that complements the decorative member 40 for retaining the decorative member 40 thereon. In this embodiment, the decorative member 40 and the insert hole 32 are substantially heart-shaped. The insert hole 32 has a confining wall which tapers gradually from a bottom side to a top side of the blade mounting end portion 31, as shown in FIG. 3. The blade mounting end portion 31 is further formed with a plurality of screw sockets 33 that are disposed around the insert hole 32 and that are to be aligned with the fastener holes 22. The screw sockets 33 are in the form of upwardly extending and internally threaded tubular sockets. The screw fasteners 50 extend through the connecting end portion 21 of the fan blade 20 to engage respectively the screw sockets 33 and retain the mounting arm 30 on the fan blade 20. The mounting arm 30 further has a rotor mounting end portion 34 for securing the mounting arm 30 on a rotor (not shown) of the ceiling fan.

Referring to FIG. 3, the decorative member 40 is made of a resilient material, such as plastic, and is fittingly retained in the insert hole 32. The decorative member 40 is formed as a hollow body which includes a bottom wall 401 and a surrounding wall 402 that extends upwardly from the bottom wall 401. The surrounding wall 402 is formed with a radial outward peripheral flange 41 which rests on a top side of the blade mounting end portion 31 for retaining the decorative member 40 on the mounting arm 30. The decorative member 40 has an upper end portion 42 formed with a plurality of angularly displaced and upwardly extending contact stubs 43 that protrude upwardly relative to distal upper ends of the screw sockets 33 when the decorative member 40 is retained on the mounting arm 30 and that abut against the bottom side of the connecting end portion 21 of the fan blade 20 when the mounting arm 30 is retained on the fan blade 20.

Figure 2:
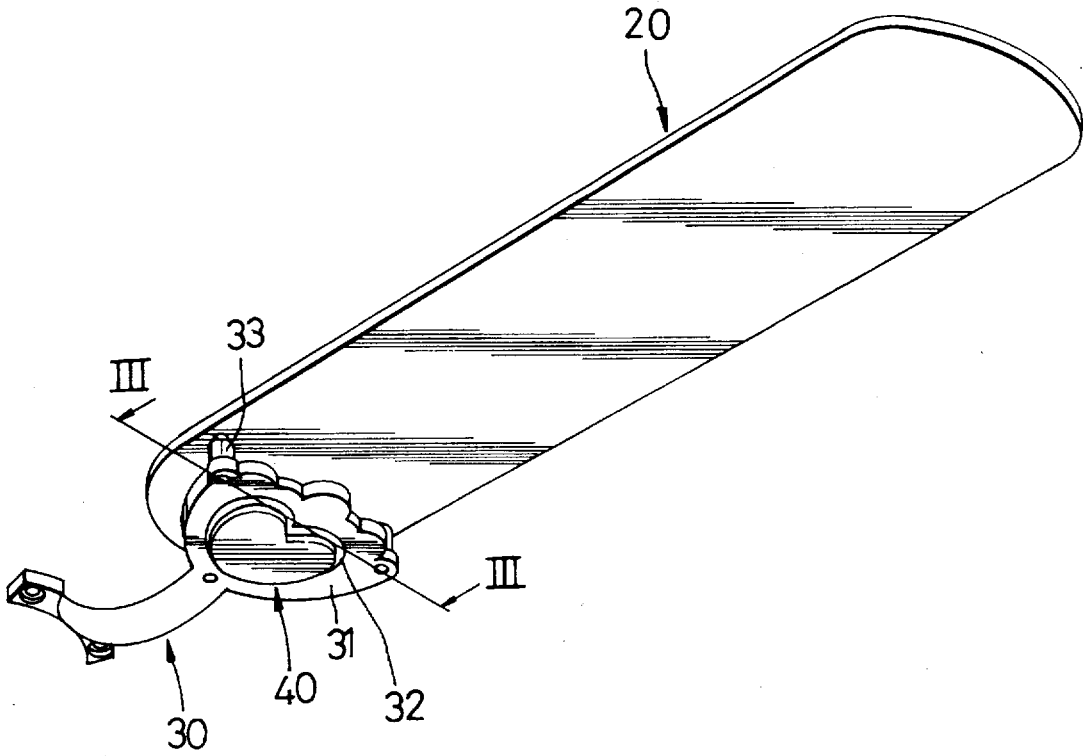
FIG. 2 is a perspective view illustrating the preferred embodiment when secured on a connecting end portion of a fan blade of a ceiling fan.

Referring to FIGS. 2 and 3, when installing the mounting device of this invention, the decorative member 40 is initially fitted in the insert hole 32 from the bottom side of the blade mounting end portion 31. The tapering confining wall of the insert hole 32 guides the entry of the decorative member 40 into the insert hole 32. The resilient properties of the decorative member 40 permit deformation of the same at the peripheral flange 41 as the decorative member 40 is extended into the insert hole 31, and expansion of the decorative member 40 such that the peripheral flange 41 rests on the top side of the blade mounting end portion 31 for retaining the decorative member 40 on the mounting arm 30. The lower end portion of the surrounding wall 402 of the decorative member 40 may project downwardly relative to a bottom side of the blade mounting end portion 31. Alternatively, the lower end portion of the surrounding wall 402 may be substantially flush with the bottom side of the blade mounting end portion 31.

Once the decorative member 40 has been retained on the mounting arm 30, the blade mounting end portion 31 is disposed horizontally beneath the connecting end portion 21 of the fan blade 20 such that the contact stubs 43 abut against the bottom side of the fan blade 20. The screw fasteners 50 are then extended through the fastener holes 22 in the connecting end portion 21 of the fan blade 20 to engage respectively the screw sockets 33 and retain the mounting arm 30 on the fan blade 20. The presence of the contact stubs 43 obviate the need to thread the screw fasteners 50 fully into the screw sockets 33 when retaining the mounting arm 30 on the fan blade 20.

Since the contact stubs 43 protrude upwardly relative to the distal upper ends of the screw sockets 33, and since the contact stubs 43 abut against the bottom side of the connecting end portion 21 of the fan blade 20, the upper and lower end portions of the decorative member 40 can be held tightly in place to prevent movement of the same relative to the fan blade 20 when the fan blade 20 rotates. Moreover, since the decorative member 40 is retained in the insert hole 32 of the mounting arm 30, the mounting device of this invention is more convenient to install as compared to the prior art which involves alignment of screw holes in the blade mounting end portion of the mounting arm with through holes in the connecting end portion of the fan blade and with screw sockets on the decorative member. Furthermore, the provision of the insert hole 32 in the blade mounting end portion 31 reduces the weight of the mounting device and results in a less expensive raw material requirement, thereby resulting in reduced costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A mounting device adapted to be secured to a bottom side of a connecting end portion of a fan blade of a ceiling fan, said mounting device comprising:

a decorative member;

a mounting arm having a plate-like blade mounting end portion which is to be disposed horizontally beneath the connecting end portion of the fan blade and which is formed with an insert hole that complements said decorative member for retaining said decorative member thereon, and a plurality of screw sockets that are disposed around said insert hole; and a plurality of screw fasteners adapted to extend through the connecting end portion of the fan blade to engage said screw sockets and retain said mounting arm on the fan blade.

2. The mounting device of claim 1, wherein said decorative member has an upper end portion that is adapted to abut against the bottom side of the connecting end portion of the fan blade when said mounting arm is retained on the fan blade.

3. The mounting device of claim 2, wherein said screw sockets are formed as upwardly extending tubular sockets, said upper end portion of said decorative member protruding upwardly relative to distal upper ends of said screw sockets when said decorative member is retained on said mounting arm.

4. The mounting device of claim 1, wherein said decorative member has an upper end portion formed with a plurality of angularly displaced and upwardly extending contact stubs that are adapted to abut against the bottom side of the connecting end portion of the fan blade when said mounting arm is retained on the fan blade.

5. The mounting device of claim 4, wherein said screw sockets are formed as upwardly extending and internally threaded tubular sockets, said contact stubs protruding upwardly relative to distal upper ends of said screw sockets when said decorative member is retained on said mounting arm.

6. The mounting device of claim 1, wherein said decorative member is formed as a hollow body which includes a bottom wall and a surrounding wall that extends upwardly from said bottom wall.

7. The mounting device of claim 1, wherein said decorative member is formed with a radial outward peripheral flange which rests on a top side of said blade mounting end portion for retaining said decorative member on said mounting arm.

8. The mounting device of claim 1, wherein said insert hole has a confining wall which tapers gradually from a bottom side to a top side of said blade mounting end portion.

9. The mounting device of claim 1, wherein said decorative member is made of a resilient material and is fittingly retained in said insert hole.

10. The mounting device of claim 9, wherein said mounting arm is made of cast metal.

11. The mounting device of claim 1, wherein said decorative member has a lower end portion which projects downwardly relative to a bottom side of said blade mounting end portion.

12. The mounting device of claim 1, wherein said decorative member has a lower end portion which is substantially flush with a bottom side of said blade mounting end portion.

* * * * *